US005545031A

United States Patent [19]

Joshi et al.

[11] Patent Number: 5,545,031

[45] Date of Patent: Aug. 13, 1996

[54] METHOD AND APPARATUS FOR INJECTING FUEL AND OXIDANT INTO A COMBUSTION BURNER

[75] Inventors: Mahendra L. Joshi, Altamonte Springs; Lee Broadway, Eustis; Patrick J. Mohr, Mims, all of Fla.

[73] Assignee: Combustion Tec, Inc., Apopka, Fla.

[21] Appl. No.: 366,621

[22] Filed: Dec. 30, 1994

[51] Int. Cl.[6] ..... F23C 5/00

[52] U.S. Cl. ..... 431/8; 239/424; 431/187

[58] Field of Search ..... 431/10, 8, 187, 431/188; 239/424, 424.5

[56] References Cited

U.S. PATENT DOCUMENTS

| | | | |
|---|---|---|---|
| 1,566,177 | 12/1925 | Whitaker | 431/187 |
| 2,813,754 | 11/1957 | Zielinski | 239/424 |
| 4,909,727 | 3/1990 | Khinkis . | |
| 4,911,637 | 3/1990 | Moore et al. . | |
| 5,076,779 | 12/1991 | Kobayashi . | |
| 5,135,387 | 8/1992 | Martin et al. . | |
| 5,169,304 | 12/1992 | Flament et al. . | |
| 5,199,866 | 4/1993 | Joshi et al. . | |
| 5,217,363 | 6/1993 | Brais et al. . | |
| 5,217,366 | 6/1993 | Laurenceau et al. . | |
| 5,256,058 | 10/1993 | Slavejkov et al. . | |
| 5,292,244 | 3/1994 | Xiong . | |
| 5,299,929 | 4/1994 | Yap . | |
| 5,346,390 | 9/1994 | Slavejkov et al. . | |
| 5,360,171 | 11/1994 | Yap . | |

*Primary Examiner*—Carroll B. Dority
*Attorney, Agent, or Firm*—Speckman, Pauley & Fejer

[57] ABSTRACT

A method and apparatus for injecting fuel and oxidant into a combustion burner. At an exit plane of a nozzle, fuel is discharged in a generally planar fuel layer which has an upper boundary and a lower boundary. Also at the exit plane, oxidant is preferably discharged in both a top layer along the upper boundary of the fuel layer and a bottom layer along the lower boundary of the fuel layer. In a downstream flow direction, the fuel and oxidant preferably converge in a generally vertical plane and diverge in a generally horizontal plane. The discharged fuel and oxidant form a fishtail or fan-shaped flame configuration. A refractory manifold can be used to further enhance the fishtail or fan-shaped flame configuration.

4 Claims, 5 Drawing Sheets

METHOD AND APPARATUS FOR INJECTING FUEL AND OXIDANT INTO A COMBUSTION BURNER

BACKGROUND OF THE INVENTION

1. Field of the Invention

Invention relates to a method and apparatus for discharging fuel and oxidant from a nozzle in a fashion that forms a fishtail or fan-shaped flame which produces uniform heat distribution and relatively high radiative heat transmission.

2. Description of Prior Art

Combustion technology involving 100% oxygen-fuel is relatively new in glass melting applications. Many conventional burners use a cylindrical burner geometry wherein fuel and oxidant are discharged from a cylindrical nozzle, such as a cylindrical refractory burner block. Such cylindrical discharge nozzles produce a flame profile that diverges at an included angle of 20° to 25°, in a generally conical shape. Conventional burners that produce generally conical flames create undesirable hot-spots in a furnace. The hot-spots result in furnace refractory damage, particularly to furnace crowns and sidewalls which are opposite the flame. Such conventional burners also result in increased batch volatilization and uncontrolled emissions of nitrogen oxides, sulfur oxides and process particulates.

To overcome some of the problems associated with such designs, conventional burners have incorporated low momentum flow wherein relatively lower oxygen and fuel velocities are used to create relatively lower momentum flames. Such lower velocities and thus lower momentums result in longer flames and increased load coverage. However, a flame lofting problem occurs at such relatively low velocities and thus causes undesirable effects.

Some conventional burners employ a staggered firing arrangement in an attempt to improve effective load coverage, particularly with the use of conical expansion of individual flames. However, the staggered firing arrangement often creates undesirable cold regions in pocket areas between adjacent burners. To overcome such problem, other conventional burners have attempted to increase the number of flames by using more burners. However, increasing the number of burners significantly increases installation and operation costs.

U.S. Pat. No. 5,217,363 teaches an air-cooled oxygen gas burner having a body which forms three concentric metal tubes supported in a cylindrical housing and positioned about a conical bore in a refractory sidewall of a furnace. The three concentric tubes can be adjusted with respect to each other, to define a nozzle with annular openings of variable size for varying the shape of a flame produced by a mixture of fuel, oxygen and air. The air is fed through an outer chamber, for cooling the concentric tube assembly and the furnace refractory positioned about the burner nozzle.

U.S. Pat. Nos. 5,256,058 and 5,346,390 disclose a method and apparatus for generating an oxy-fuel flame. The oxy-fuel flame is produced in a concentric orifice burner and thus results in a generally cylindrical flame. A fuel-rich flame is shielded within a fuel-lean or oxygen-rich flame. The flame shielding is controlled in order to achieve a two-phase turbulent diffusion flame in a precombustor, in order to prevent aspiration of corrosive species and also to reduce nitrogen oxides formation.

U.S. Pat. No. 5,076,779 discloses a combustion burner operating with segregated combustion zones. Separate oxidant mixing zones and fuel reaction zones are established in a combustion zone, in order to dilute oxidant and also to combust fuel under conditions which reduce nitrogen oxides formation.

It is apparent that there is a need for an oxy-fuel burner which can be used in high-temperature furnaces, such as glass melting furnaces, that provides uniform heat distribution, reduced undesirable emissions, such as nitrogen oxides and sulfur oxides, and which produces a highly radiative and luminous flame.

SUMMARY OF THE INVENTION

It is one object of this invention to provide a burner nozzle which produces a fishtail or fan-shaped flame resulting in improved load coverage and a highly radiative flame, particularly for efficient transmission of visible radiation in a wavelength range of approximately 500 nanometers to approximately 2000 nanometers, for example.

It is another object of this invention to provide a burner nozzle that produces a fishtail or fan-shaped flame wherein the fuel and oxidant are uniformly distributed in a generally horizontal direction, particularly when discharged from the nozzle.

It is another object of this invention to provide a horizontally diverging burner block that allows the fuel and oxidant discharged from the nozzle to be further directed outward in a horizontally diverging direction, in order to enhance development of the fishtail or fan-shaped flame configuration.

The above and other objects of this invention are accomplished with a method and apparatus for injecting fuel and oxidant into a combustion burner, wherein the fuel is discharged from a nozzle in a generally planar fuel layer, forming a fishtail or fan-shaped fuel layer having a generally planar upper boundary and a generally planar lower boundary. Oxidant is discharged from the nozzle so that a generally planar oxidant layer is formed at least along the upper boundary of the fuel layer and preferably also along the lower boundary of the fuel layer.

In one preferred embodiment according to this invention, a fuel manifold is positioned within an oxidant manifold. Both the fuel manifold and the oxidant manifold preferably have a rectangular cross section at an exit plane, for producing the fishtail or fan-shaped flame configuration. In one preferred embodiment according to this invention, both the fuel manifold and the oxidant manifold have a generally square-shaped cross section at an upstream location, which converges in a generally vertical direction and diverges in a generally horizontal direction to form the generally rectangular cross section at the exit plane. The combined converging and diverging effect, as a result of the geometry of the fuel manifold and the oxidant manifold, produces a net transfer of momentum of the fluid from a generally vertical plane to a generally horizontal plane. Thus, the fuel and oxidant are discharged from the nozzle in a relatively wide and uniformly distributed fashion. The relatively wide distribution produces the fishtail or fan-shaped flame configuration.

It is apparent that the dimensions of the discharge nozzle or discharge nozzles can be varied to achieve certain desired fuel and oxidant velocities. Such dimensions are designed in order to achieve desired combustion gas velocities and flame development in a downstream flow direction.

According to another preferred embodiment of this invention, the fuel and oxidant are discharged from the nozzle into a burner block, such as a burner block constructed of refractory, which enhances development of an oxy-fuel flame into a fishtail or fan-shaped configuration. Downstream of the nozzle exit plane, the generally planar fuel layer is sandwiched between generally planar top and bottom layers of oxidant. The discharge nozzle preferably produces a fuel-rich central or core layer and an oxygen-rich top and bottom layer. Peak flame temperatures remain relatively low in the horizontally diverging manifold section of the burner block, due to the limited amount of oxygen and fuel combustion taking place within the burner block. The oxygen-rich top and bottom layers flow over the refractory or burner block surfaces and thus result in convective cooling of the refractory or burner block.

As the fuel and oxidant mixture flows through the burner block, partial combustion takes place and thus raises the pressure and temperature of the partially combusted fuel and oxidant mixture. The partial combustion causes relatively hot gases to expand in all directions. Because the manifold section of the burner block preferably maintains a constant distance between the upper and lower flow surfaces but diverges between the opposing side flow surfaces, in the downstream flow direction, the burner block or manifold section geometry further assists the partially combusted fuel and air mixture to diverge in the general horizontal planar direction. Such enhanced diverging flow results in a relatively wider or more pronounced fishtail or fan-shaped flame configuration.

According to the method and apparatus of this invention, the velocity of the oxidant and fuel discharged from the manifold section of the burner block is relatively lower which thus enables a relatively fuel-rich combustion to occur in the horizontally central core region of the overall fishtail or fan-shaped flame configuration. In the horizontally central core region, the fuel undergoes a cracking reaction because of the relatively slow reaction between the fuel and the oxidant, and because of the relatively large surface area of the nozzle. The fuel cracking produces a relatively large amount of soot particles, aromatics and hydrogen. The formed soot particles react with oxygen to produce a highly luminous and relatively long flame. Such highly luminous and relatively long flame can be at least two times more radiative, in visible wavelength spectrum, than conventional oxy-fuel burners having cylindrical block geometry. The fishtail or fan-shaped flame configuration produced by the method and apparatus according to this invention has a flame envelope that is significantly larger than the envelope produced by conventional cylindrical block burners. Thus, the method and apparatus according to this invention produces a relatively high radiative heat-flux to the load, which results in higher throughput and increased fuel efficiency.

BRIEF DESCRIPTION OF THE DRAWINGS

The above-mentioned and other features of this invention will become more apparent, and the invention itself will be best understood by reference to the following description of specific embodiments of the invention taken in conjunction with the accompanying drawings, in which.

DESCRIPTION OF PREFERRED EMBODIMENTS

Figure 1:
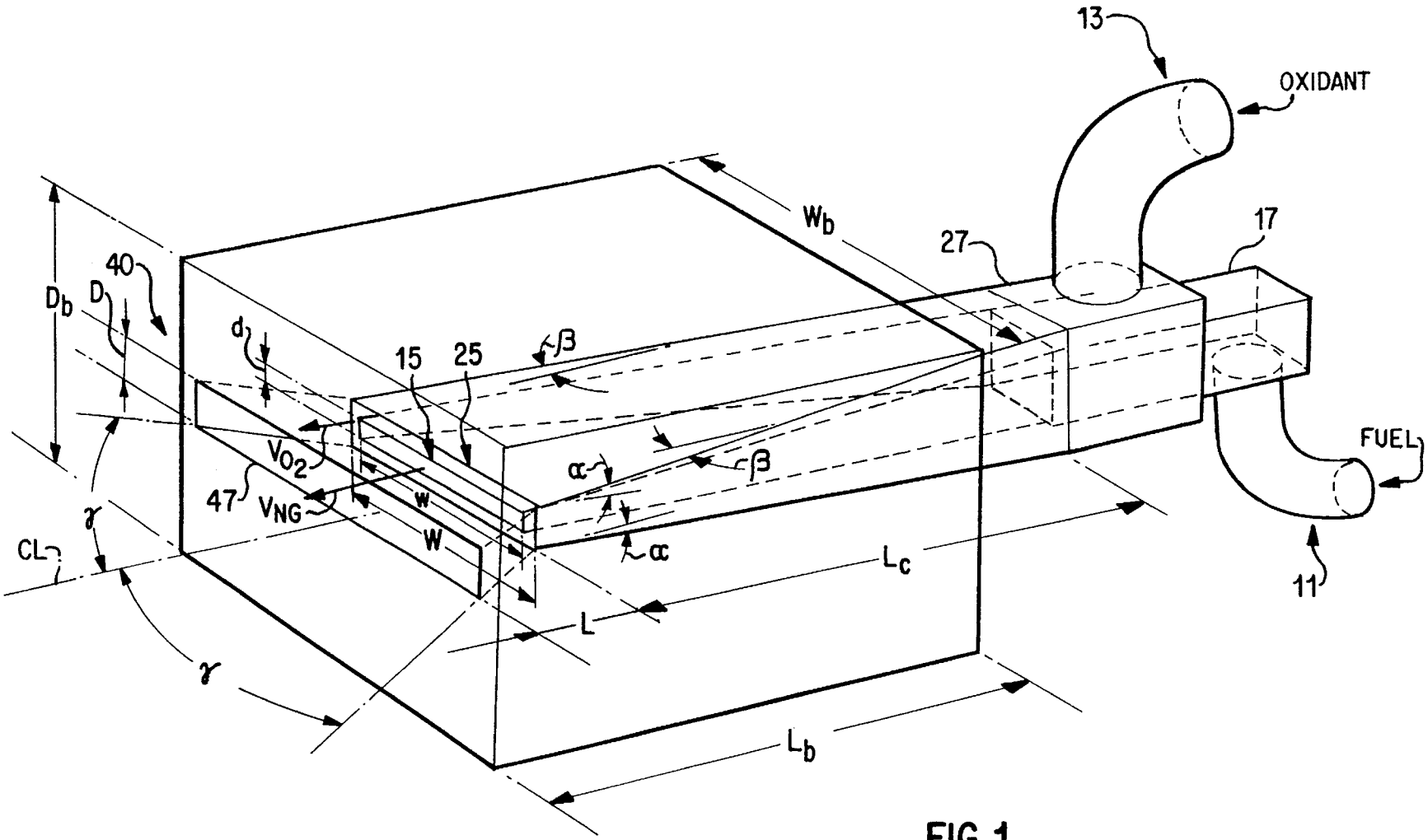
FIG. 1 is a perspective schematic view of an apparatus that produces a fishtail or fan-shaped flame configuration, according to one preferred embodiment of this invention.

Referring to FIGS. 1–5, fuel is introduced into fuel manifold 17 through fuel inlet means 11, and oxidant is introduced into oxidant manifold 27 through oxidant inlet means 13. It is apparent that fuel inlet means 11 and oxidant inlet means 13 may comprise a fuel inlet nozzle and oxidant inlet nozzle, as shown in FIG. 1, or may comprise any other suitable inlet means for introducing fuel and oxidant into corresponding manifolds, as known to those skilled in the art.

As used throughout this specification and in the claims, the term fuel is intended to interchangeably relate to any suitable gaseous fuel, vaporized liquid fuel, liquified gas, or any other fuel suitable for combustion purposes. One preferred fuel is natural gas. As used throughout this specification and in the claims, the term oxidant is intended to interchangeably relate to oxygen, air, oxygen-enriched air, or any other suitable oxidant known to those skilled in the art. One preferred oxidant used in connection with the method according to this invention is pure or 100% oxygen. The combination of pure or 100% oxygen and natural gas is often used in high-temperature furnaces, such as glass melting furnaces.

According to one preferred embodiment of this invention, an apparatus for injecting the fuel and the oxidant into a combustion burner comprises fuel discharge nozzle 15 and oxidant discharge nozzle 25. Fuel means are used to discharge the fuel from fuel discharge nozzle 15, in a generally planar fuel layer which has a generally planar upper boundary and a generally planar lower boundary. First oxidant means are used to discharge a first portion of the oxidant from oxidant discharge nozzle 25, in a generally planar first oxidant layer, preferably along the upper boundary of the fuel layer. Second oxidant means are used to discharge a second or remaining portion of the oxidant from oxidant discharge nozzle 25, also in a generally planar second oxidant layer, preferably along the lower boundary of the fuel layer.

As used throughout this specification and in the claims, the phrase generally planar layer is intended to relate to a fluidic layer of gas or vaporized fuel, for example, having a defined thickness and an overall generally planar shape. Such generally planar layer may also be referred to as a blanket of gas or vaporized liquid. The generally planar layer of fuel and oxidant are formed within fuel discharge nozzle 15 and oxidant discharge nozzle 25, respectively. Upstream of the generally vertical exit plane at fuel discharge nozzle 15 and oxidant discharge nozzle 25, the fuel and oxidant are formed into separate generally planar layers. Downstream of the exit plane, the generally planar layers of fuel and oxidant begin to commingle at their common boundaries and continue to mix as the flow proceeds in the downstream direction.

At the generally vertical exit plane established at the outlet of fuel discharge nozzle 15 and at the outlet of oxidant discharge nozzle 25, the generally planar fuel layer is sandwiched between the first oxidant layer and the second oxidant layer. As the oxidant and fuel flow in the downstream direction, the oxidant begins to mix with the fuel to create a fuel-rich phase layer of a fuel/oxidant mixture which is sandwiched between two oxygen-rich phase layers of the fuel/oxidant mixture. Because of the fuel-rich central region and the oxygen-rich top and bottom regions, the peak flame temperatures of combustion occurring shortly downstream of fuel discharge nozzle 15 and oxidant discharge nozzle 25 are extremely low. Such relatively low peak flame temperatures result in reduced undesirable emissions. With the oxygen-rich top and bottom layers of fuel/oxidant mixture flow, convective cooling of refractory manifold 47 occurs.

In one preferred embodiment according to this invention, the fuel means used to discharge the fuel from fuel discharge nozzle 15 comprise fuel manifold 17 having a generally rectangular cross section at a downstream portion of fuel manifold 17. As best shown in FIG. 1, according to one preferred embodiment of this invention, fuel manifold 17 has a generally square cross section at an upstream portion. As fuel manifold 17 extends into the downstream portion, the cross section becomes much more rectangular, with a long side of the rectangle preferably positioned in a generally horizontal direction.

Figure 2:
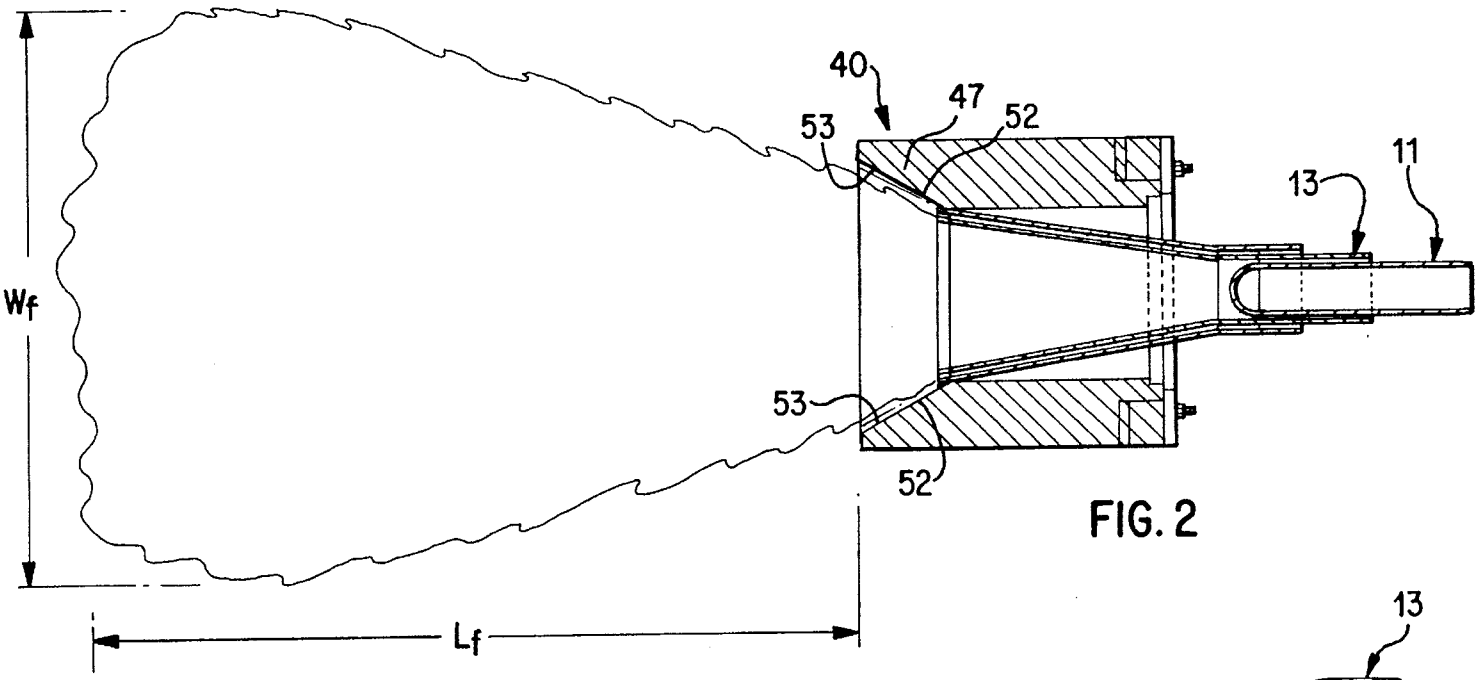
FIG. 2 is a cross-sectional top view of the apparatus shown in FIG. 1, with a fishtail or fan-shaped flame being discharged from an exit plane of a burner block.
Figure 3:
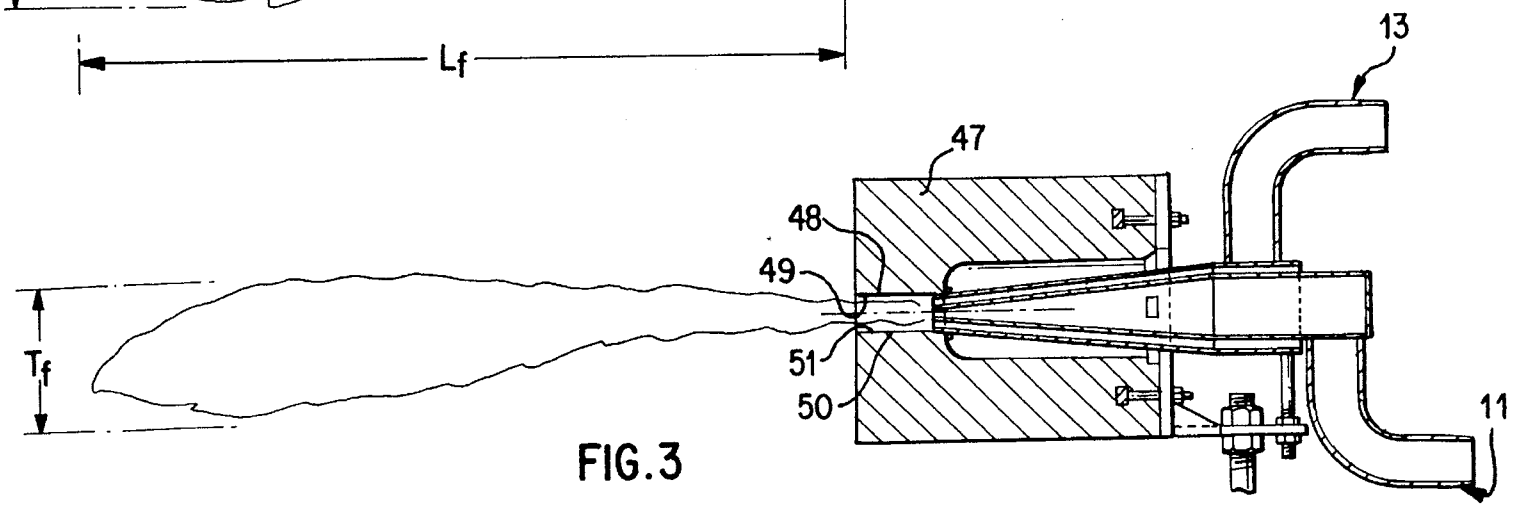
FIG. 3 is a cross-sectional side view of the fishtail or fan-shaped apparatus shown in FIG. 1, with the fishtail or fan-shaped flame being discharged, as shown in FIG. 2.
Figure 4:
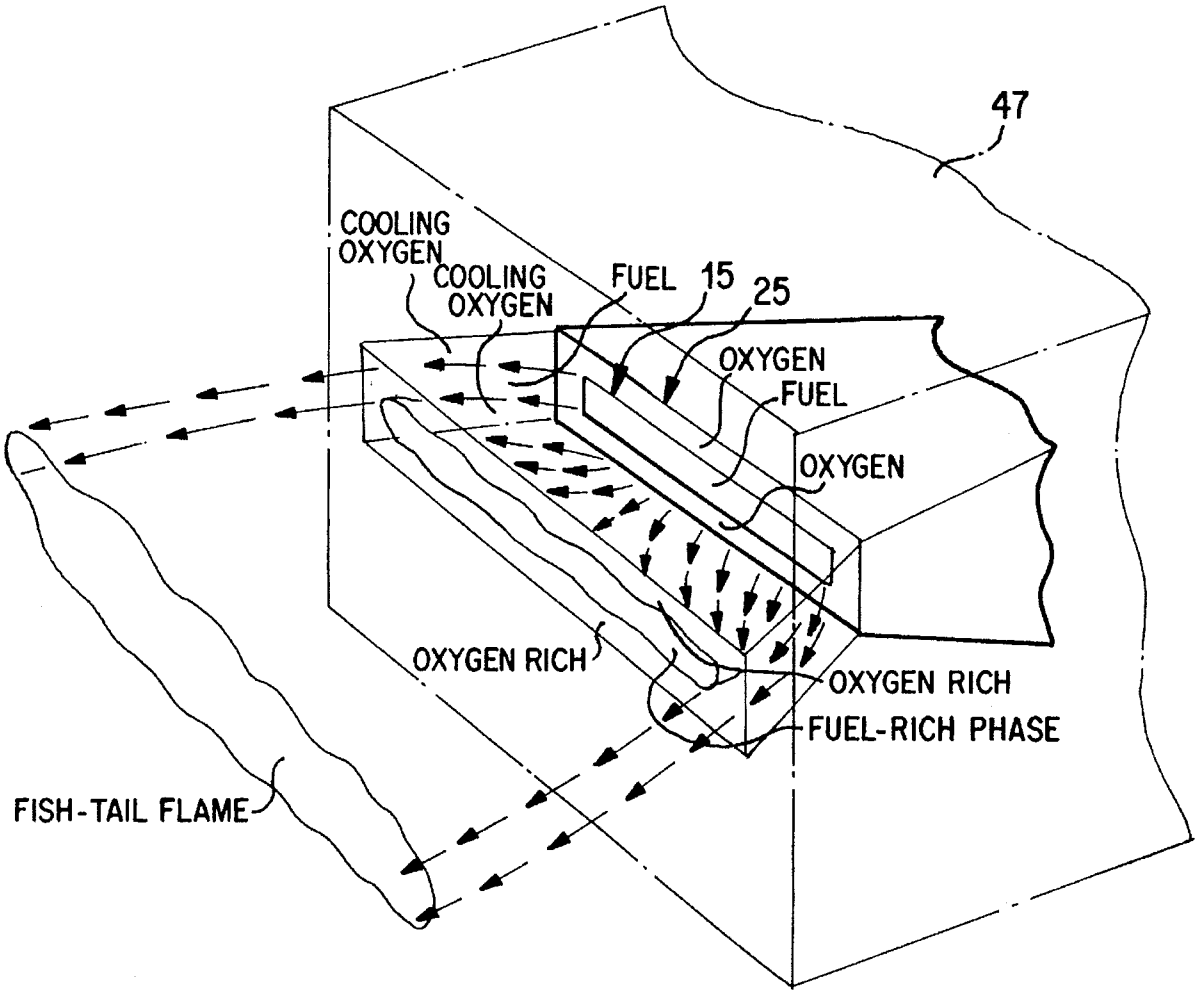
FIG. 4 is a perspective schematic view of the different layers of fuel and oxidant being discharged from a nozzle and the burner block, according to one preferred embodiment of this invention.

As used throughout this specification and in the claims, vertical and horizontal directions are preferably referred to with respect to gravitational forces. However, the terms vertical and horizontal are intended to specify directions with respect to each other and are not necessarily limited to directions with respect to the gravitational forces. As shown in FIGS. 1–3, the fishtail or fan-shaped flame configuration has the flat portion of the flame generally oriented in the horizontal direction, which is preferred. However, it is apparent that such flat portion can be oriented at any other suitable angle, which would accomplish the same result of producing a fishtail or fan-shaped flame with a fuel-rich layer sandwiched between two oxidant-rich layers. With the flat portion oriented at another suitable angle, the generally horizontal direction would not be with respect to gravitational forces.

As clearly shown in FIGS. 1–5, the fuel means further comprise upper flow surface 19 of upper wall 18 and lower flow surface 21 of lower wall 20 diverging in the downstream flow direction. Opposing side flow surfaces 23 of opposing side walls 22 each preferably converge in the downstream flow direction. Opposing side flow surfaces 23 preferably meet or intersect with upper flow surface 19 and lower flow surface 21.

The overall shape of oxidant manifold 27 is preferably but not necessarily similar to that of fuel manifold 17. According to one preferred embodiment of this invention, upper flow surface 29 of upper wall 28 and lower flow surface 31 of lower wall 30 also diverge in the downstream flow direction. Opposing side flow surfaces 33 of opposing side walls 32 preferably converge in the downstream flow direction. Opposing side flow surfaces 33 preferably meet or intersect with upper flow surface 29 and lower flow surface 31.

In one preferred embodiment according to this invention, fuel manifold 17 is positioned within oxidant manifold 27, as clearly shown in FIG. 1. A major portion of fuel manifold 17 is shown in dashed or hidden lines in FIG. 1, since fuel manifold 17 is positioned within oxidant manifold 27.

Figure 5:
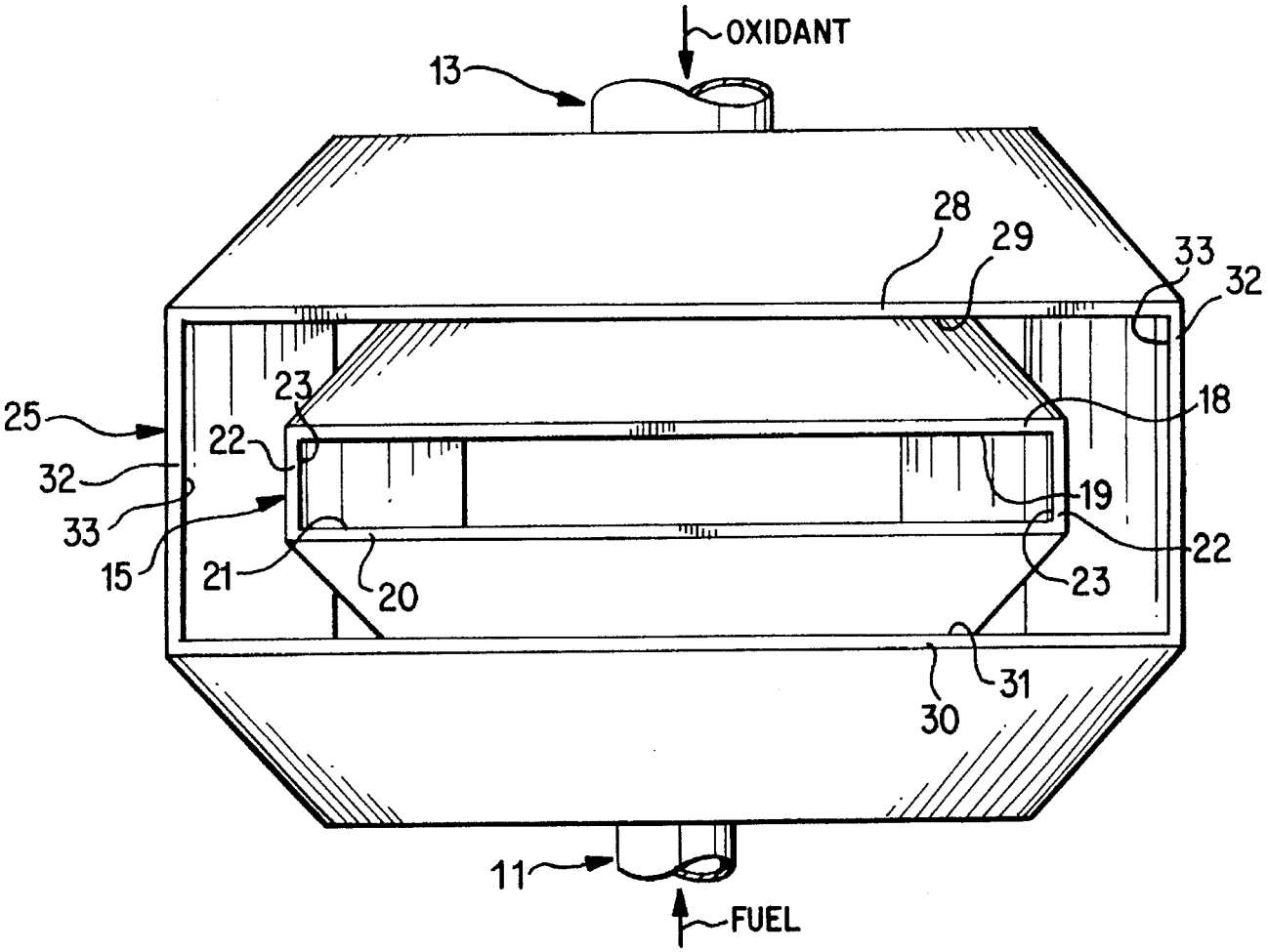
FIG. 5 is a front view of a discharge nozzle at an exit plane, looking in an upstream flow direction, according to one preferred embodiment of this invention.
Figure 6:
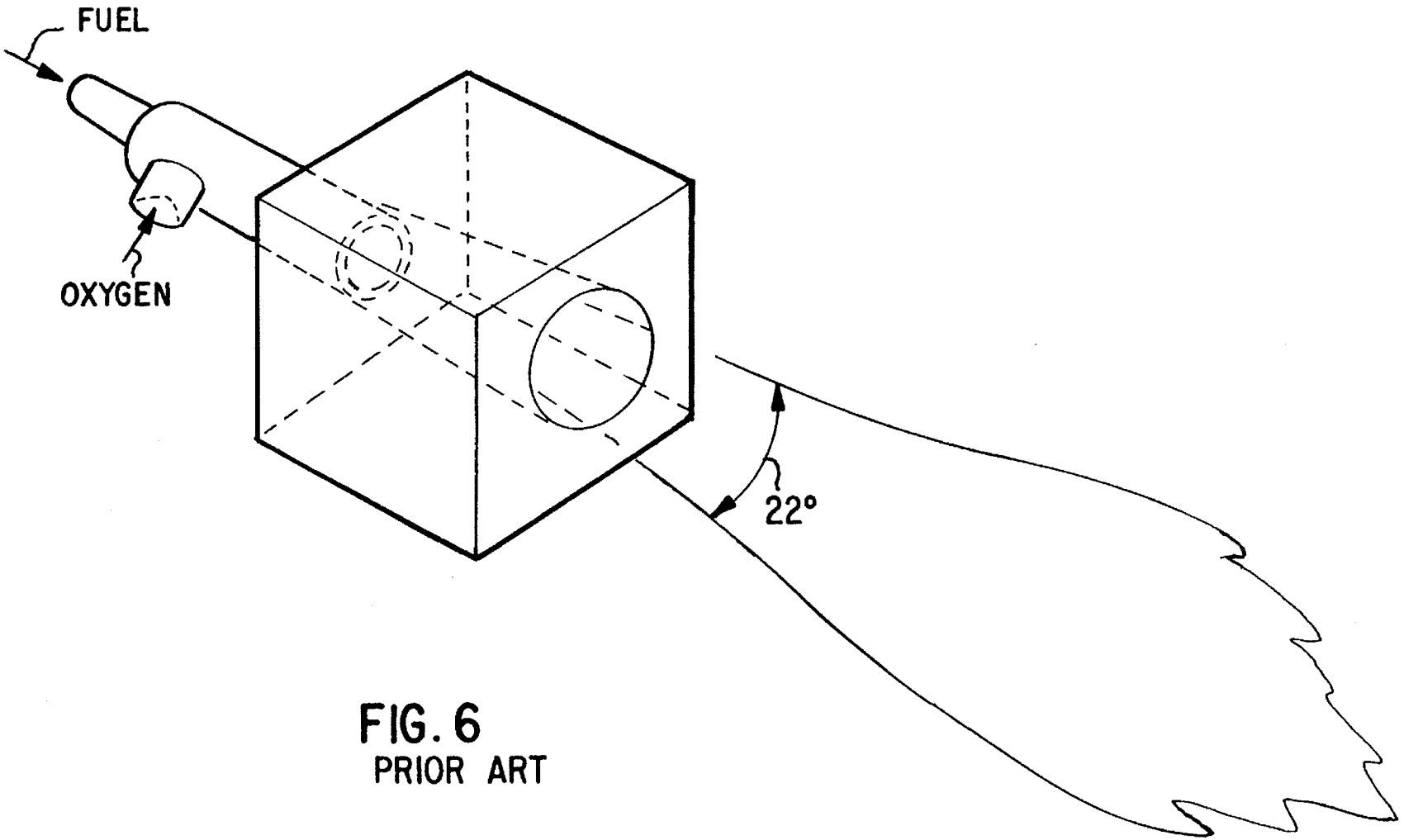
FIG. 6 PRIOR ART
FIG. 6 is a perspective schematic view of a conventional cylindrical burner which produces a generally conical flame.

As clearly shown in FIG. 5, an oxidant flow channel is defined between upper wall 18 and upper wall 28, between lower wall 20 and lower wall 30, and preferably also between opposing side walls 22 and respective opposing side walls 32. In one preferred embodiment according to this invention, as clearly shown in FIGS. 1, 4 and 5, the oxidant flowing between corresponding side flow surfaces 23 and 33 also sandwiches the fuel layer, in a side-to-side manner.

The converging effect that both the oxidant and the fuel experience in the downstream flow direction promotes uniform distribution of the fuel and oxidant, particularly at the generally vertical exit plane located at the outlets of fuel discharge nozzle 15 and oxidant discharge nozzle 25.

As shown in FIG. 1, convergence angle $\alpha$ is the angle at which opposing side flow surfaces 23 converge, and preferably but not necessarily the angle at which opposing side flow surfaces 33 converge. Divergence angle $\beta$ is the angle at which upper flow surface 19 and lower flow surface 21 diverge, and preferably but not necessarily the angle at which upper flow surface 29 and lower flow surface 31 diverge. Divergence angle $\gamma$ is the included angle at which the flame diverges, as measured from the centerline direction of refractory manifold 47.

As the fuel and oxidant are discharged from fuel discharge nozzle 15 and oxidant discharge nozzle 25, respectively, the generally planar layers of flow are preferably directed into divergent means 40 for enhancing the horizontal divergence of fuel from fuel discharge nozzle 15 and oxidant from oxidant discharge nozzle 25, in the downstream flow direction. In one preferred embodiment according to this invention, divergent means 40 comprise refractory manifold 47 having a generally rectangular cross section. Upper flow surface 49 of upper wall 48 and lower flow surface 51 of lower wall 50 preferably diverge in the downstream flow direction. The distance between upper flow surface 49 and lower flow surface 51 is preferably maintained constant. By maintaining such distance constant, because of expansion forces associated partial combustion within refractory manifold 47, the fuel and oxidant diverge in the horizontal direction and thus further enhance the fishtail or fan-shaped flame configuration. The approximate configuration of the fishtail or fan-shaped flame is clearly shown in FIG. 2.

FIG. 1 shows various dimensions which may be critical to the method and apparatus of this invention, depending upon the particular use of the burner. The method and apparatus of this invention were experimentally tested and preferred ranges of such dimensions are discussed below, as well as the effect upon the burner performance by varying such dimensions. It should be noted that the following ranges of dimensions, angles and velocities are those which are preferred based upon experiments conducted with the method and apparatus of this invention. However, it should be noted that further experimentation could reveal other suitable dimensions, angles, ratios and velocities outside of the preferred ranges. The dimensions, angles, ratios and velocities discussed below are not intended to limit the scope of this invention.

Convergence angle $\alpha$, as shown in FIG. 1, is measured within a generally vertical plane. According to one preferred embodiment of this invention, convergence angle $\alpha$ is approximately 3° to approximately 8°. Convergence angle $\alpha$ represents the slope at which side flow surfaces 23 and side flow surfaces 33 converge with respect to the horizontal. A properly selected convergence angle $\alpha$ allows the respective flow surface to adequately squeeze or pinch the fuel or oxidant streamlines in the flow axis, so that the fuel or oxidant flow converges at a somewhat steady rate without undue turbulence. The transfer of fluidic momentum of the fuel or oxidant, from the vertical plane to the horizontal plane, is a function of convergence angle $\alpha$, as well as divergence angle $\beta$. A proper balance between the design of convergence angle $\alpha$ and divergence angle $\beta$ is required for adequately converging and simultaneously diverging the flow streamlines of both the fuel and the oxidant.

According to one preferred embodiment of this invention, divergence angle $\beta$ is preferably in a range of approximately 6° to approximately 12°. Convergence angle $\beta$ is measured in a generally horizontal plane and dictates the degree to which upper flow surface 19, lower flow surface 21, upper flow surface 29 and lower flow surface 31 diverge in the generally horizontal direction. Because of divergence angle $\beta$, the fluidic fuel stream and the fluidic oxidant stream each expand while each such fluid is simultaneously forced to converge within their respective manifold, due to convergence angle $\alpha$. When divergence angle $\beta$ is too large, empty fluidic pockets can form near sidewalls 22 and sidewalls 32 of fluid discharge nozzle 15 and oxidant discharge nozzle 25, respectively. When divergence angle $\beta$ is too small, relatively heavy fluid distribution can occur closer to the center of fuel discharge nozzle 15 or oxidant discharge nozzle 25. A proper combination of both convergence angle $\alpha$ and divergence angle $\beta$ will result in uniformly distributed fuel and oxidant streams across the exit cross section of fuel discharge nozzle 15 and oxidant discharge nozzle 25, which will ultimately result in uniform flame development and uniform cooling of refractory manifold 47.

According to one preferred embodiment of this invention, the ratio $L_c/W$, the convergence length $L_c$ to the divergence width W of oxidant discharge nozzle 25, is preferably in a range of approximately 1 to approximately 3. The ratio $L_c/W$ is heavily based upon the values of convergence angle $\alpha$ and divergence angle $\beta$. The ratio $L_c/W$ is also based upon the firing capacity of the burner. For relatively higher firing rates the ratio $L_c/W$ is a larger number, and for relatively lower firing rates the ratio $L_c/W$ is a smaller number.

According to one preferred embodiment of this invention, the ratio W/D, the width W to the depth D of oxidant discharge nozzle 25, is preferably in a range of approximately 3 to approximately 6. A relatively higher ratio W/D tends to spread the oxidant in the horizontal plane, whereas a relatively lower ratio W/D tends to increase the thickness of the oxidant layer in the generally vertical plane, at given values for the oxidant velocity, the firing rate, convergence angle $\alpha$ and divergence angle $\beta$. The oxidant velocity, depending upon the burner firing rate, is preferably in a range from approximately 5 to approximately 100 ft/sec.

According to one preferred embodiment of this invention, the ratio w/d, which is a ratio of the width w to the depth d of fuel discharge nozzle 15, is preferably in a range of approximately 15 to approximately 25. A relatively higher ratio w/d tends to spread the fuel in the horizontal plane, whereas a relatively lower ratio w/d tends to increase the thickness of the fuel layer, when measured in the vertical plane. The ratio w/d is selected depending upon the desired fuel velocity discharged from fuel discharge nozzle 15, at given values for the firing rate, convergence angle $\alpha$ and divergence angle $\beta$. When the fuel is natural gas, a preferred range of fuel velocities, depending upon the burner firing rate, is from approximately 5 to approximately 150 ft/sec.

According to another preferred embodiment of this invention, flame divergence angle $\gamma$, which is measured in the generally horizontal plane, from the centerline axis of refractory manifold 47 as shown in FIG. 1, is preferably in a range from approximately 20° to approximately 40°. Flame divergence angle $\gamma$ depends upon the design of refractory manifold 47. The divergence of the flame discharged from refractory manifold 47 is influenced by flame divergence angle $\gamma$. A relatively lower flame divergence angle $\gamma$ intensifies the combustion process and a relatively higher flame divergence angle $\gamma$ reduces the overall cooling effect of the oxidant on the flow surfaces of refractory manifold 47. A properly selected flame divergence angle $\gamma$ will result in optimum divergence of the flame due to combustion induced expansion of relatively hot combustion gases, for greater load coverage. A properly selected flame divergence angle $\gamma$ will also assist in stabilizing the combustion process within refractory manifold 47, or another suitable burner block, and thus will optimize the cooling effect upon refractory manifold 47. A properly selected flame divergence angle $\gamma$ will also result in refractory manifold 47 being completely filled with relatively hot combustion gases, which also prevents inspiration of furnace gases or particulates into refractory manifold 47, or another suitable burner block.

According to another preferred embodiment of this invention, the ratio L/D, which is a ratio of the flow length L to the flow depth D of refractory manifold 47, is preferably in a range of approximately 1.5 to approximately 2.5. The ratio L/D influences the flame luminosity, as well as the cooling effect caused by the oxidant flow over upper flow surface 49 of upper wall 48, lower flow surface 51 of lower wall 50 and side flow surfaces 53 of sidewalls 52. A relatively higher ratio L/D tends to accelerate the fuel/oxidant combustion process and thus reduce the thickness of the oxidant layers which sandwich the fuel layer. Depending upon the particular design of the burner, an oxidant layer thickness of approximately ⅜" to approximately ¾" is preferred for adequate cooling of refractory manifold 47. A properly selected L/D ratio will result in good flame luminosity and partial fuel cracking within the central fuel layer. As the L/D ratio is increased, such as beyond approximately 2.5, the combustion process can become more intense within refractory manifold 47, the generation of soot species can be significantly reduced, and the flame luminosity can also be reduced. By lowering the L/D ratio, such as lower than approximately 1.5, the residence time for the hot gases to expand and shape the flame becomes too short.

The velocities of the fuel and oxidant at the nozzle exit plane become important design parameters when the combustion burner operates with pure or 100% oxygen and fuel. Through experimentation, a prototype of a method and apparatus according to this invention produced a turndown ratio of 10:1, for a firing range of 0.5 to 5 MM BTU/hr. Such turndown ratio was effective for a fuel velocity in a range of approximately 8 to approximately 80 ft/sec, and an oxidant velocity in the range of approximately 4 to approximately 40 ft/sec, which resulted in a suitably shaped fishtail configuration and a highly luminous flame. Relatively higher velocities can be achieved by using smaller nozzle exit areas and would likely result in reduced flame luminosity. With the firing rate in the range of approximately 0.5 to approximately 5 MM BTU/hr, the flame length $L_f$ varied between approximately 4 ft to approximately 8 ft, the flame width $W_f$ varied between approximately 3 to approximately 5 ft, and the flame thickness $T_f$ varied between approximately 3 to approximately 6 in, and had the overall approximate shape as generally indicated in FIGS. 2 and 3. According to another preferred embodiment of this invention, the length $L_b$ of the burner block, as shown in FIG. 1, was chosen as approximately 10 to approximately 18 in. The width $W_b$ of the burner block was chosen to be in a range of approximately 12 to approximately 24 in. The depth $D_b$ of the burner block was chosen to be in a range of approximately 12 to approximately 16 in. The experiments were conducted with pure or 100% oxygen as the oxidant and natural gas as the fuel. It is apparent that other firing rates and values for the burner design parameters can be selected, which would significantly vary the angles, ratios, velocities and dimensions as previously discussed. The values of such parameters as discussed above are intended to represent an example of values for such parameters that have been proven based upon conducted experiments. It is apparent that further experimentation could reveal values for such parameters which fall outside of the ranges, as discussed above, without significantly affecting the performance of the method and apparatus according to this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method of dispersing fuel and oxidant from a burner, the method including the steps of: dispersing the fuel from an inner nozzle in a generally planar fuel layer, the inner nozzle having upper and lower substantially planar walls converging with respect to each other and side walls diverging with respect to each other;

an outer nozzle spaced about said inner nozzle and having upper and lower substantially planar walls converging with respect to each other and side walls diverging with respect to each other passing an oxidant through the outer nozzle, about said inner nozzle and in contact with the fuel dispersed from the inner nozzle.

2. A burner for dispersing fuel and oxidant into a combustion zone, the burner comprising: an inner nozzle for dispersing fuel in a generally planar fuel layer, the inner nozzle having upper and lower substantially planar walls converging with respect to each other and side walls diverging with respect to each other and forming a substantially rectangular outlet;

an outer nozzle spaced about said inner nozzle for dispersing oxidant and having upper and lower walls converging with respect to each other and side walls diverging with respect to each other and forming a substantially rectangular outlet.

3. The method of claim 1 further including discharging the fuel and oxidant from the burner through a refractory member having substantially planar upper and lower walls and side walls diverging with respect to each other and forming a substantially rectangular outlet.

4. The burner of claim 2 further including a refractory member located about the burner; said refractory member having substantially planar upper and lower walls and side walls diverging with respect to each other and forming a substantially rectangular opening through which fuel and oxidant from the burner pass.

* * * * *

UNITED STATES PATENT AND TRADEMARK OFFICE

CERTIFICATE OF CORRECTION

PATENT NO. : 5,545,031

DATED : 13 August 1996

INVENTOR(S) : Mahendra L. JOSHI, Lee BROADWAY, and Patrick J. MOHR

It is certified that error appears in the above—identified patent and that said Letters Patent is hereby corrected as shown below:

Title page, item [54] and col. 1, lines 1-3,

Delete the title in its entirety and in its place insert

--METHOD AND APPARATUS FOR DISPERSING FUEL AND OXIDANT FROM A BURNER--

Signed and Sealed this

Twelfth Day of November, 1996

Bruce Lehman

*Attest:*

BRUCE LEHMAN

*Attesting Officer*

*Commissioner of Patents and Trademarks*